US005989203A

United States Patent [19]

Wang

[11] Patent Number: 5,989,203

[45] Date of Patent: Nov. 23, 1999

[54] STEAM MASSAGING DEVICE

[76] Inventor: Chun-chung Wang, 9, Lane 1096, Chun Jih Road, Taoyuan, Taiwan

[21] Appl. No.: 08/691,345

[22] Filed: Aug. 2, 1996

[51] Int. Cl.[6] ..... A61H 33/06

[52] U.S. Cl. ..... 601/15; 601/22; 601/134

[58] Field of Search ..... 601/154, 155, 601/160, 134, 15, 16, 18, 22; 604/291; 607/111, 108

[56] References Cited

U.S. PATENT DOCUMENTS

| | | | |
|---|---|---|---|
| 1,424,756 | 7/1922 | Arnoa | 604/291 |
| 3,749,092 | 7/1973 | Williams | 604/24 |
| 4,292,971 | 10/1981 | Smit et al. | 128/256 |
| 4,399,349 | 8/1983 | Deming et al. | 219/276 |
| 4,446,855 | 5/1984 | Friedson | 601/15 |
| 5,056,507 | 10/1991 | Yum | 601/136 |
| 5,098,414 | 3/1992 | Walker | 604/291 |

*Primary Examiner*—Kien T. Nguyen
*Assistant Examiner*—Benjamin K. Koo
*Attorney, Agent, or Firm*—Bacon & Thomas

[57] ABSTRACT

A steam massaging device includes a steam generator, a main tube and a massaging means. The steam generator comprises a boiler, a seal lid and a steam outlet. The steam outlet has one end located above the boiler and the other end connected to one end of the main tube. The main tube has the other end connected to the massaging means for conducting steam to an interior of the massaging means. The massaging means comprises at least one massaging plate assembly or one massaging rod assembly. The massaging plate assemblies are interconnected, and the massaging rod is connected to the massaging plate assembly/assemblies so that steam can flow through them. The massaging device may be used to massaging the back and waist as well as the soles.

5 Claims, 5 Drawing Sheets

STEAM MASSAGING DEVICE

BACKGROUND OF THE INVENTION (a) Field of the Invention

The present invention relates generally to a sole massaging device, and more particularly to a massaging device comprising a steam generator for generating heat which is uniformly distributed to a massaging plate assembly and a massaging rod assembly for massaging the soles and other parts of the body.

(b) Description of the Prior Art

Nowadays, people are busy with their jobs and have little time for exercising. Lack of proper exercise may result in poor blood circulation and hence backaches, limb soreness, hyper-tension, headaches, dizziness, etc. It has been known that sole massaging is helpful in stimulating blood circulation.

There are available massaging pads or plates with pebbles fitted thereon for stimulating the soles of a user walking or stepping thereon. There are also available plastic plates of rugged surface simulating a pebbled path for the same purpose. However, to better stimulate blood circulation, especially in cold winters, it is necessary to provide a useful sole massaging device capable of generating heat. Two major reasons account for the lack of such useful devices: Firstly, it is difficult to mount thermal wires in conventional rugged massaging pads or plates; besides, the heat cannot be distributed evenly to each massaging point. Secondly, in the case of plastic massaging pads or plates, they will deform in shape or melt if the heat is too high; even worse, fire accidents may result. In the case of metal massaging pads or plates, there is the possibility of electricity leakage. Although there is available on the market a heating type massaging plate attached to a vibrating plate, it is comprised of a flat metal plate and hence cannot provide stimulation to the soles. Besides, there is the disadvantage of possible electricity leakage. That is the reason why such heating type massaging plate is not popular.

SUMMARY OF THE INVENTION

Accordingly, a primary object of the present invention is to provide a steam massaging device in which the steam is evenly distributed to each massaging point.

Another object of the present invention is to provide a steam massaging device in which the steam temperature is maintained at a safe and stable range.

A further object of the present invention is to provide a steam massaging device in which the steam generated by a steam generating means is conducted via a tube to a massaging means to eliminate the possibility of electricity leakage as in the prior art.

Still another object of the present invention is to provide a steam massaging device in which a massaging means such as a pebbled pad or plate may be made of plastic materials instead of metal to reduce costs.

Still a further object of the present invention is to provide a steam massaging device in which steam is evenly distributed to every massaging points to effectively stimulate blood circulation without causing discomfort to the user.

Still a further object of the present invention is to provide a steam massaging device comprising a massaging means on which a user may rest to stimulate the circulation of blood in the back and waist and a massaging rod which may be used independently to massage the body not only to stimulate blood circulation but also to stimulate perspiration for the purposes of slimming.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
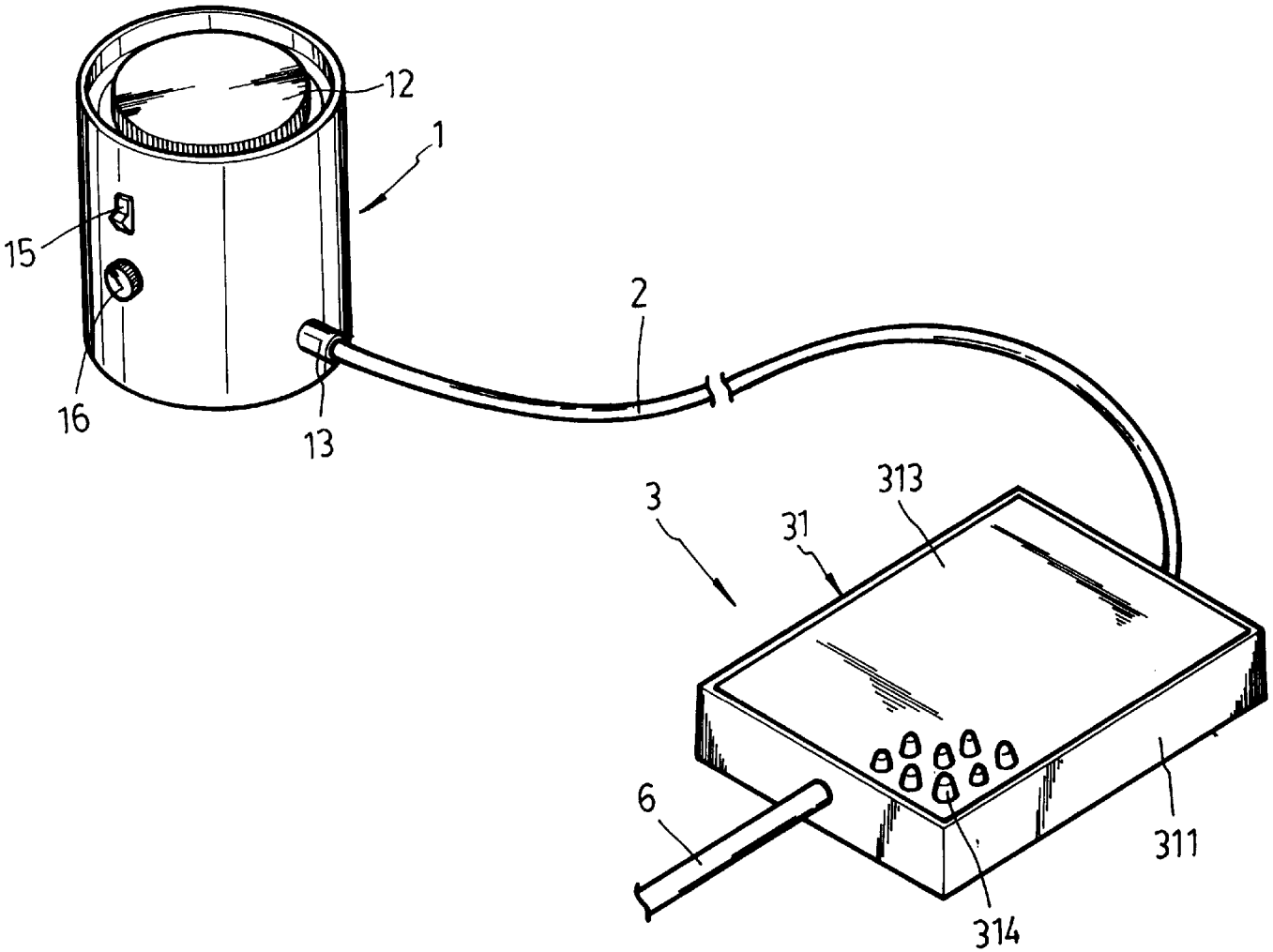
FIG. 1 is an elevational view of a first preferred embodiment of the present invention.
Figure 2:
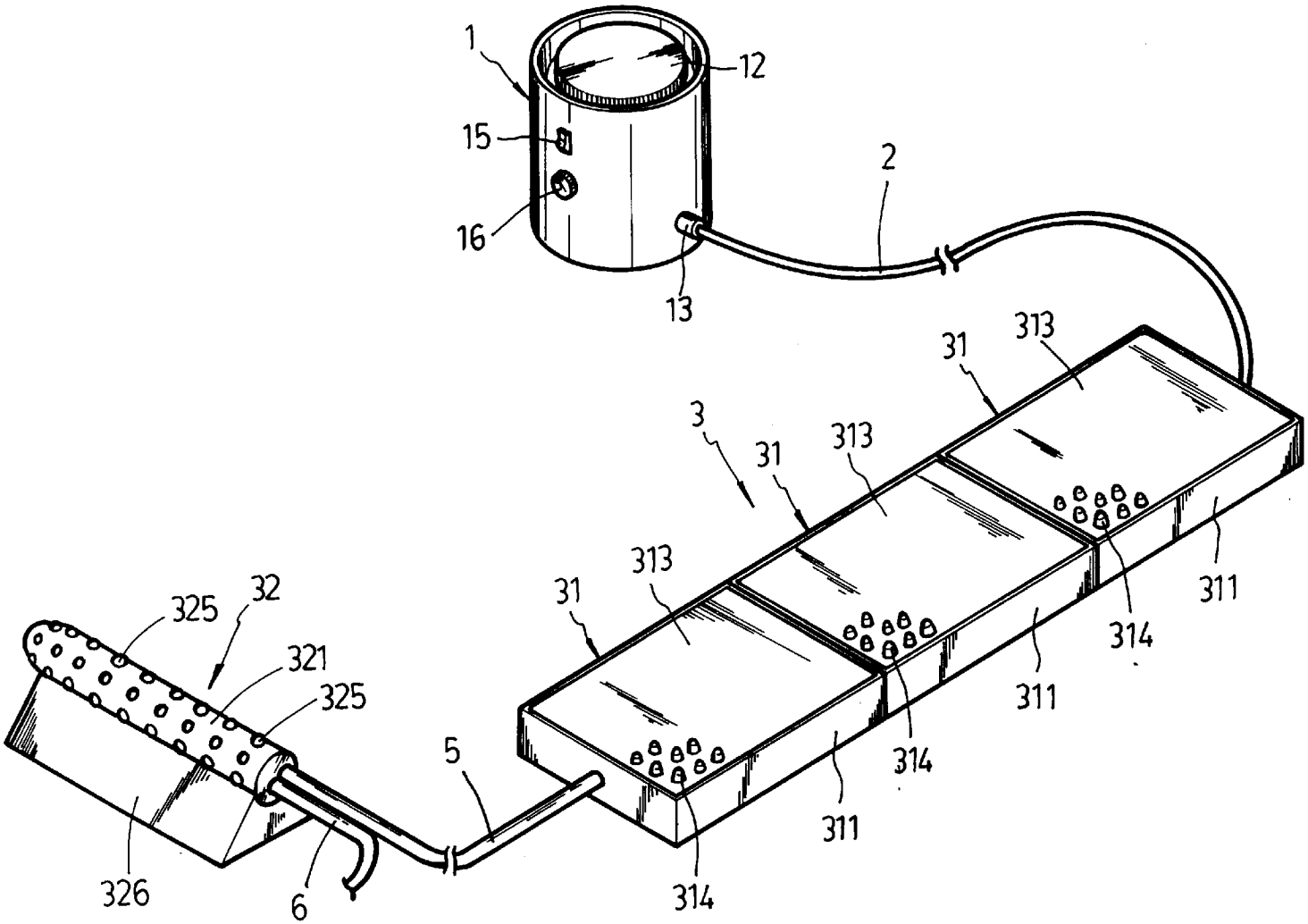
FIG. 2 is an elevational view of a second preferred embodiment of the present invention.

With reference to FIGS. 1 and 2, the steam massaging device of the present invention essentially comprises a steam generator 1, a main tube 2, a massaging means 3, a connecting tube 5 and a discharge tube 6.

The steam generated by the steam generator 1 is conducted via the main tube 2 to the interior of the massaging means 3. The massaging means 3 comprises at least one massaging plate assembly 31 or a massaging rod assembly 32 for massaging the soles. The massaging plate assembly 31 and the massaging rod assembly 32 are connected by the connecting tube 5 for passage of steam from the steam generator 1. Steam is discharged through the discharge tube 6. In the embodiment shown in FIG. 1 in which the massaging means 3 comprises only a single massaging plate assembly 31, the steam is directly discharged through the discharge tube 6 after passing through the massaging plate assembly 31.

Figure 3:
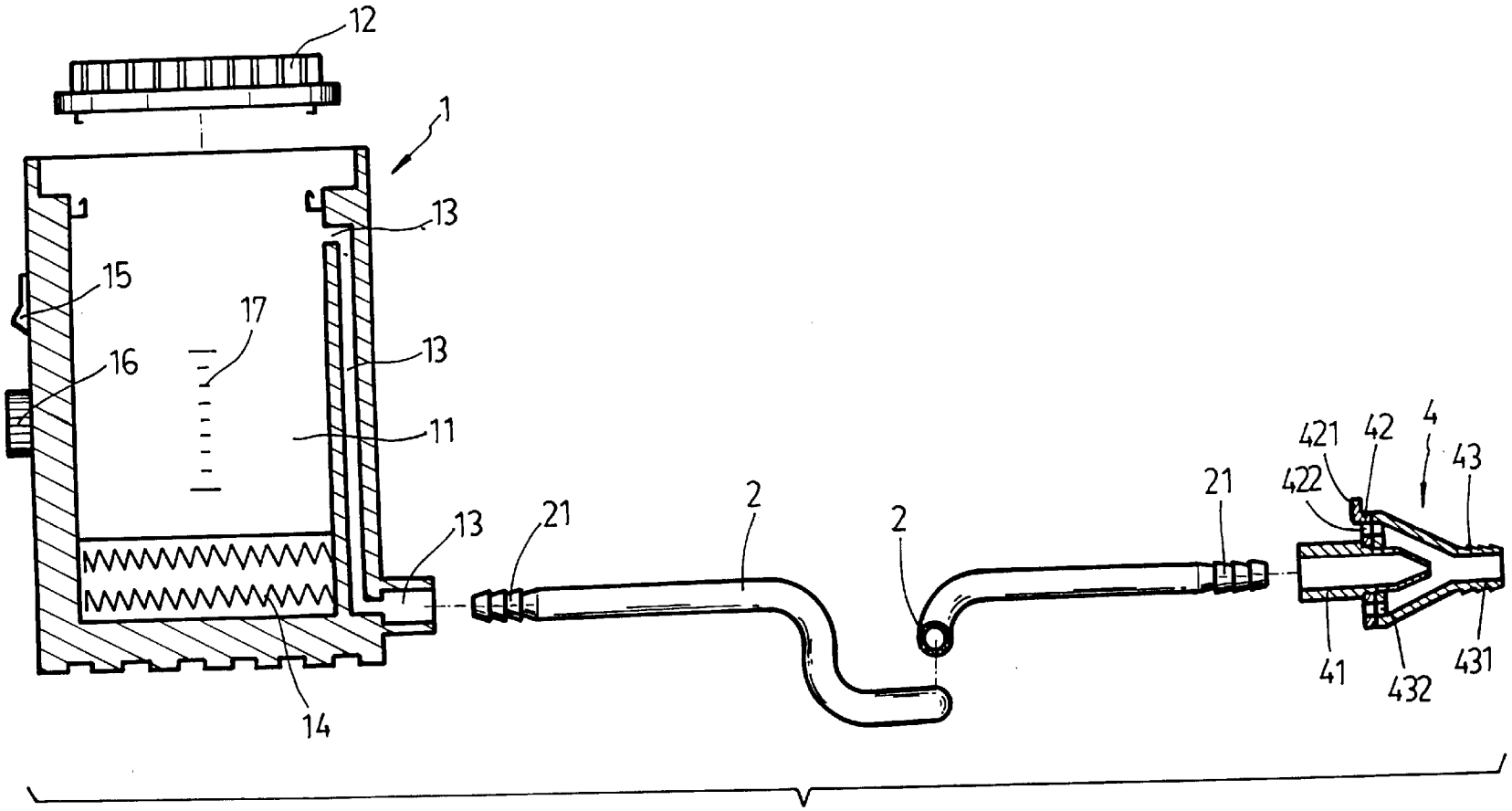
FIG. 3 is a sectional view of a third preferred embodiment of the present invention used in conjunction with a temperature regulator.

With reference to FIG. 3, the present invention further comprises a temperature regulator 4 disposed between the main tube 2 and the massaging means 3 for regulating the temperature of the steam. The temperature of the steam is regulated by adjusting flow of air into the steam massaging device. Generally, the temperature of the steam that reaches the massaging means 3 via the main tube 2 from the steam generator 1 can be accepted or endured by the human body. The arrangement of the temperature regulator 4 is to enable the steam massaging device to be adapted to different room temperatures. For instance, in summer, more air flow can be allowed to lower the temperature of the steam.

Referring to both FIGS. 2 and 3, the steam generator 1 comprises a power switch 15 and a timer 16 both disposed on an outer side thereof, a boiler 11, a steam outlet 13, and heating coils 14 all accommodated therewithin. The boiler 11 has a removable seal lid 12. When the lid 12 is removed, water can be poured into the boiler 11 to a suitable level as indicated by a water level scale 17. Water in the boiler 11 is heated by the heating coils 14 to generate steam which escapes via the steam outlet 13 through the main tube 2 to the massaging means 3. The steam outlet 13 passes through the interior of the steam generator 1 with one end located at the upper end of the boiler 11 near the lid 12 and the other end communicating with a first connecting end 21 of the main tube 2.

Figure 4:
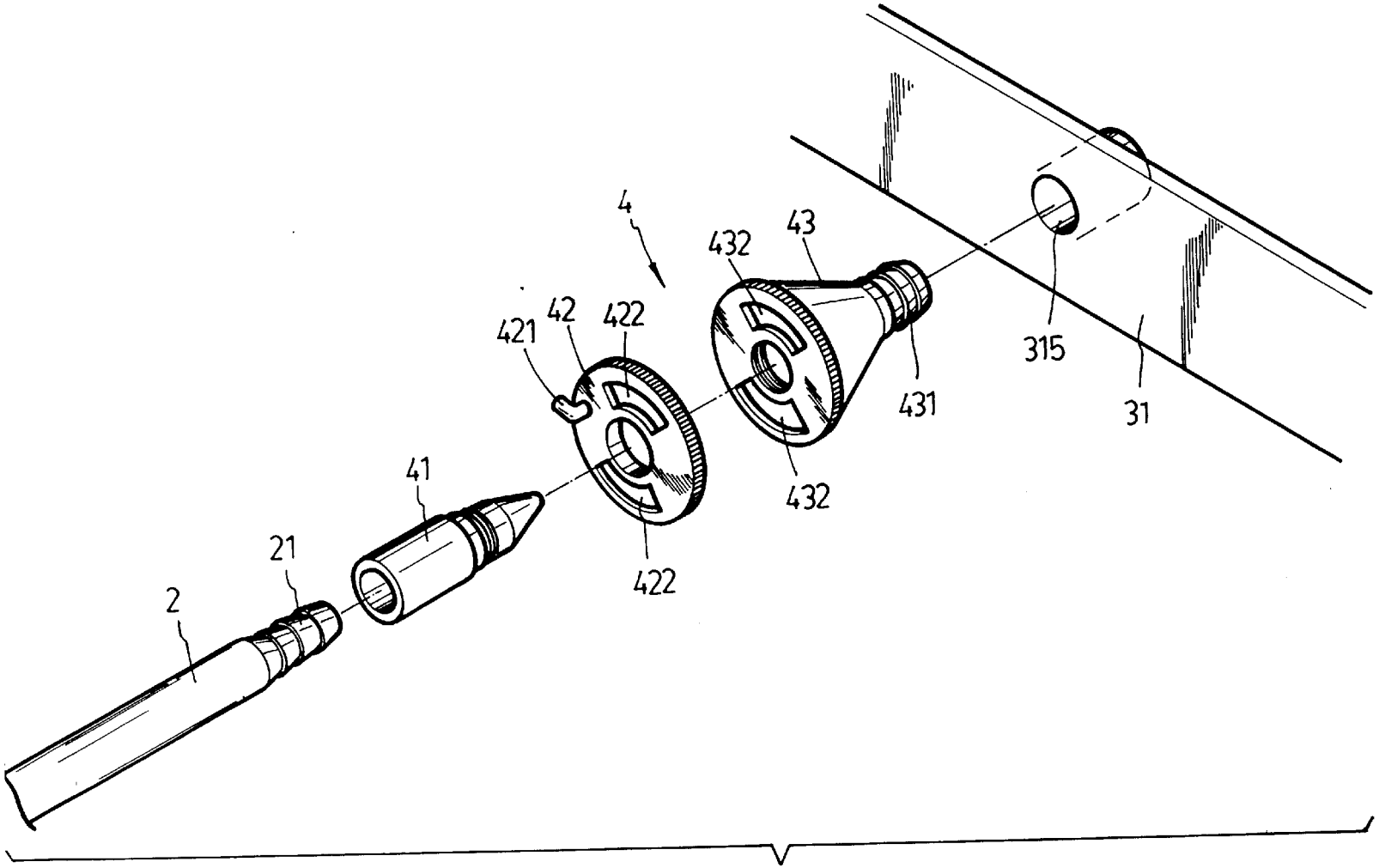
FIG. 4 is an elevational exploded view of the temperature regulator.

With reference to FIGS. 3 and 4, the temperature regulator 4 includes a nozzle 41, an air regulating valve 42 and a regulator body 43. The nozzle has one end connected to a second connecting end of the main tube 2 and the other end forming a jet for sending jets of steam within the regulator body 43 at a fast speed. The speed of the jets of steam draws air in and the air mixes with the steam to lower the latter's temperature. The flow of induced air is chiefly controlled by turning a button 421 of the air regulating valve 42 to open or close an air port 432 between an air inlet 422 and the regulator body 43. And a connecting head 431 of the regulator body 43 may be directly inserted into a connecting receptacle 315 of the massaging plate assembly 31 for supplying the massaging plate assembly 31 with steam. Obviously, the connecting head 431 may also be directly connected to a connecting hole 322 of the massaging rod assembly 32.

Figure 5:
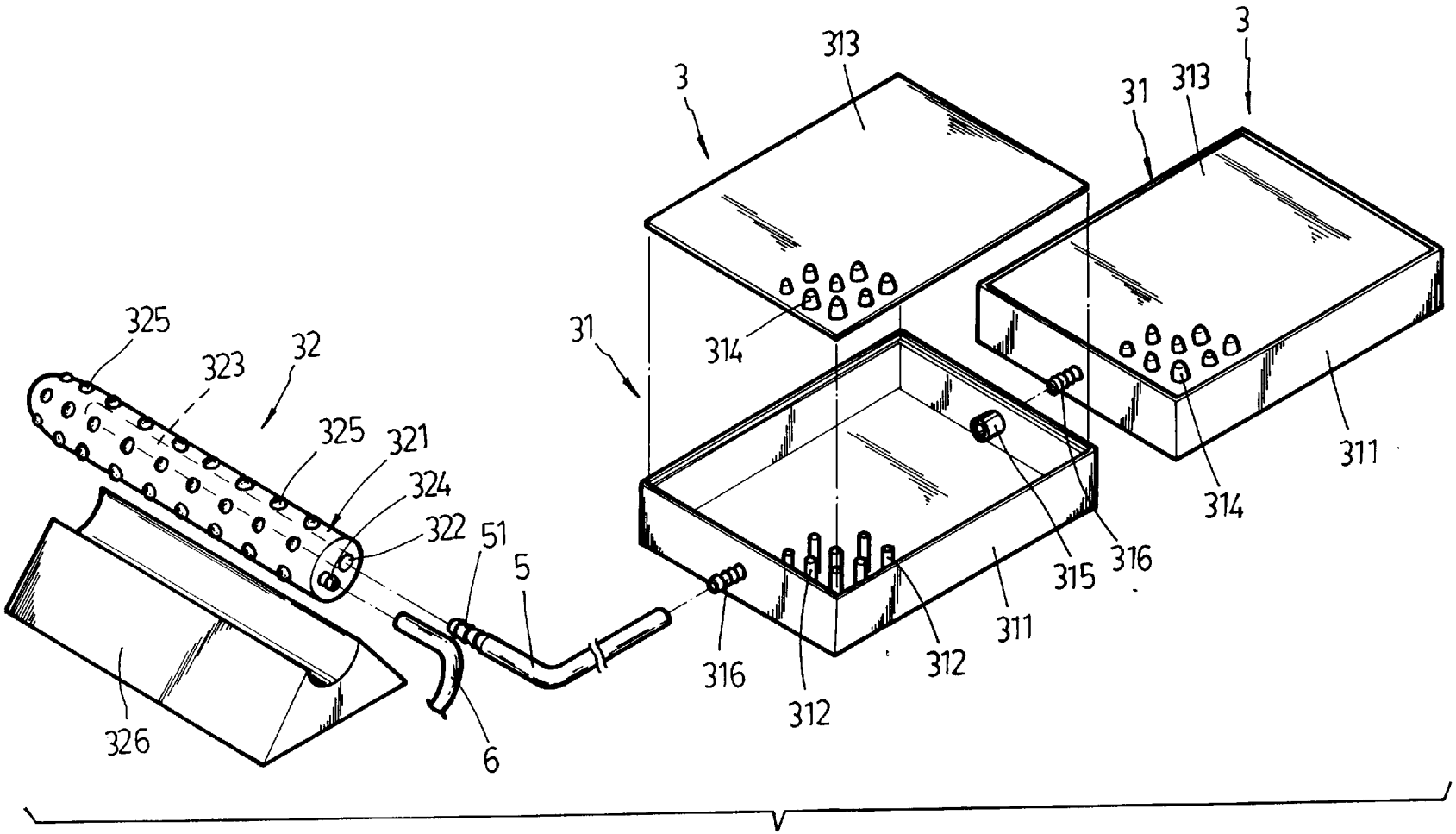
FIG. 5 is an elevational exploded view of a massaging means of the present invention.

Referring to FIGS. 1, 2 and 5, the massaging means 3 comprises at least one massaging plate assembly 31 or one massaging rod assembly 32. Alternatively, it may also comprise a plurality of massaging plate assemblies 31 and one massaging rod assembly 32 in which the massaging plate assemblies 31 are inter-connected and the massaging rod assembly 32 is connected to the massaging plate assemblies 31. The massaging plate assembly 31 includes a bottom box body 311 and a massaging plate 313 with a plurality of massaging bosses 314 fitted thereon, the massaging plate 313 being fitted on top of the bottom box body 311. The bottom box body 311 is provided with the connecting receptacle 315 and a connecting element 316 such as a connecting rod respectively at both ends so that the massaging plate assemblies 31 may be inter-connected and also connected to the main tube 2 and the connecting tube 5. A plurality of support posts 312 are arranged within the bottom box body 311 for supporting the bases of the bosses 314 on the massaging plate 313 such that the entire massaging plate 313 of each massaging plate assembly 31 may be properly supported. Spaces are left in the bottom box body 311 to allow flow of steam therein and even distribution of steam. The user may step on the bosses 314 to achieve sole massaging. He/she may also lie on the massaging plates 313 to massage other parts of the body particularly the back and the waist.

The massaging rod assembly 32 comprises a massaging rod 321 having a plurality of bosses 325 on its surface and a base 326. The massaging rod 321 has connecting hole 322 at one end thereof for accommodating an inner tube 323 which may conduct steam into the interior of the massaging rod 321 before the steam is discharged via a connecting element 324 such as a connecting rod disposed next to the connecting hole 322 at the same end of the massaging rod 321 into the discharge tube 6. The massaging rod 321 is normally placed on the base 326, and the user may step on the bosses 325 to achieve sole massaging. The massaging rod 321 may also be removed from the base 326 and used to massage the body.

Although the present invention has been illustrated and described with reference to the preferred embodiment thereof, it should be understood that it is in no way limited to the details of such embodiment but is capable of numerous modifications within the scope of the appended claims.

What is claimed is:

1. A steam massaging device comprising:

a) a steam generator having a lower portion with a heating device located therein, the steam generator forming a boiler into which water is placed to a predetermined maximum level and a removable lid covering the boiler;

b) a steam passageway having a steam inlet communicating with the boiler above the maximum level of the water and a steam outlet communicating exteriorly of the steam generator;

c) at least one massaging device forming a steam chamber having a steam chamber inlet and a steam chamber outlet, the at least one massaging device further comprising a massaging plate with a plurality of massaging bosses extending outwardly therefrom and a bottom body supporting the massaging plate and forming the steam chamber, the bottom body having a plurality of support posts supporting the massaging plate;

d) a main tube connected to the steam outlet and the steam chamber inlet to direct steam from the steam passageway to the steam chamber; and, e) a discharge tube connected to the steam chamber outlet to discharge steam from the steam chamber remotely from the at least one massaging device.

2. The massaging device of claim 1 further comprising a steam temperature regulator connected to the main tube between the steam generator and the at least one massaging device.

3. The massaging device of claim 2 wherein the steam temperature regulator comprises:

a) a nozzle connected to the main tube for ejecting steam therefrom;

b) a regulator body connected to the at least one massaging device and enclosing the nozzle, the regulator body having at least one air inlet; and, c) an air regulating valve connected to the regulator body to control the amount of air passing through the at least one air outlet.

4. A steam massaging device comprising:

a) a steam generator having a lower portion with a heating device located therein, the steam generator forming a boiler into which water is placed to a predetermined maximum level and a removable lid covering the boiler;

b) a steam passageway having a steam inlet communicating with the boiler above the maximum level of the water and a steam outlet communicating exteriorly of the steam generator;

c) at least one massaging device forming a steam chamber having a steam chamber inlet and a steam chamber outlet, the at least one massaging device having a surface with a plurality of massaging bosses extending outwardly therefrom;

d) a main tube connected to the steam outlet and the steam chamber inlet to direct steam to the steam chamber;

e) a discharge tube connected to the steam chamber outlet to discharge steam from the steam chamber remotely from the at lest one massaging device; and, f) a steam temperature regulator connected to the main tube between the steam generator and the at least one massaging device wherein the steam temperature regulator comprises:

i) a nozzle connected to the main tube for ejecting steam therefrom;

ii) a regulator body connected to the at least one massaging device and enclosing the nozzle, the regulator body having at least one air inlet; and, iii) an air regulating valve connected to the regulator body to control the amount of air passing through the at least one air inlet.

5. The massaging device of claim 4 wherein the at least one massaging device comprises a massaging rod having an outer surface from which the plurality of massaging bosses extend.

* * * * *